US006768252B2

(12) United States Patent
Yang

(10) Patent No.: US 6,768,252 B2
(45) Date of Patent: Jul. 27, 2004

(54) MAGNETIC SHIELD STRUCTURE FOR COLOR CATHODE RAY TUBE

(75) Inventor: Beung Jae Yang, Daegu-shi (KR)

(73) Assignee: LG Electronics Inc., Seoul (KR)

( * ) Notice: Subject to any disclaimer, the term of this patent is extended or adjusted under 35 U.S.C. 154(b) by 11 days.

(21) Appl. No.: 09/888,560

(22) Filed: Jun. 26, 2001

(65) Prior Publication Data

US 2002/0030429 A1 Mar. 14, 2002

(30) Foreign Application Priority Data

Jul. 25, 2000 (KR) ..... 2000-42853

(51) Int. Cl.[7] ..... H01J 29/06

(52) U.S. Cl. ..... 313/479; 313/402; 313/407; 313/239

(58) Field of Search ..... 313/402, 479, 313/238, 239, 404–408

(56) References Cited

U.S. PATENT DOCUMENTS 6,005,314 A * 12/1999 Park et al. ..... 313/479

6,459,194 B1 * 10/2002 Akita ..... 313/402

FOREIGN PATENT DOCUMENTS

| | | |
|---|---|---|
| JP | 5-314919 | 11/1993 |
| JP | 5-325815 | 12/1993 |

* cited by examiner

*Primary Examiner*—Ashok Patel
(74) *Attorney, Agent, or Firm*—Fleshner & Kim, LLP

(57) ABSTRACT

A magnetic shield structure for a color cathode ray tube is provided which can improve color chrominance, rotation redundancy and magnetic field redundancy of the color cathode ray tube, by preventing an electron beam from being moved due to an earth magnetic field, so that the electron beam can be landed on a designated fluorescent material. Accordingly, in a color cathode ray tube including a tension mask assembly comprising a tension mask for color-discriminating an electron beam, and a main frame and a sub frame for supporting the tension mask, and a magnetic shield structure disposed at a funnel, for preventing deflection and distortion of the electron beam, the magnetic shield structure includes a main unit for shielding the inner sides of the funnel, and a front unit where the tension mask assembly is inserted.

22 Claims, 6 Drawing Sheets

MAGNETIC SHIELD STRUCTURE FOR COLOR CATHODE RAY TUBE

BACKGROUND OF THE INVENTION

1. Field of the Invention

The present invention relates to a magnetic shield structure for a color cathode ray tube, and in particular to an improved inner shield structure which can shield all sides of a tension mask assembly.

2. Description of the Related Art

In general, a color cathode ray tube includes a flat panel 1 composing a screen; a funnel 2 disposed at the rear portion of the panel 1, an electron gun being inserted into its neck unit; and a deflecting yoke 5 disposed at the outer circumferential surface of the neck unit, for deflecting an electron beam 6 scanned from the electron gun.

Here, a fluorescent surface 4 for coating red, green and blue fluorescent materials on a black matrix of the panel 1 is positioned in the funnel 2 and the panel 1, and a tension mask 3 is positioned separately from the fluorescent surface 4, so that the electron beam 6 scanned from the electron gun can be color discriminated and landed on the fluorescent surface 4.

The tension mask 3 is supported by a main frame 14 and a sub frame 13, thus composing a tension mask assembly. The tension mask assembly is fixed by stud pins disposed at the respective inner side portions of the panel 1. An inner shield 9 is provided at the rear portion of the frames so that the electron beam 6 can pass through the funnel 2, not distorted by an earth magnetic field.

As illustrated in FIGS. 2A and 2B, the conventional inner shield 9 includes: a beam shield 17 disposed at the rear portion of the main frame 14, for shielding the rear portion of the main frame 14; and a shield 18 for shielding the inside of the funnel, so that the path of the electron beam passing the funnel cannot be distorted.

Here, a section of the shield 18 is formed in a trapezoidal shape having no top and bottom surfaces. The shield 18 may be incorporated with the beam shield 17, or connected with the beam shield 17 by fixing pins.

On the other hand, in the structure where the sub frame 13 and the main frame 14 are welded, the tension mask 3 is welded on the main frame 14 by applying force to the sub frame 13, and the force applied to the sub frame 13 is removed, thus fabricating the tension mask assembly.

Accordingly, when the inner shield 9 is disposed at the rear portion of the tension mask assembly, the main frame 14 and the tension mask 3 are not influenced by the earth magnetic field due to direct welding. However, since the sub frame 13 and the tension mask 3 are not connected, a side space 19 between the main frame 14 and the tension mask 3 is exposed to the earth magnetic field.

Referring to FIGS. 3A and 3B, another conventional inner shield 9 includes: a beam shield 17 having a protrusion for shielding a frame at its lower portion; and a shield 18 having its section formed in a trapezoidal shape to shield the inside of the funnel.

The inner shield 9 is also disposed at the rear portion of the tension mask assembly, so that the beam shield 17 can shield the inner sides and rear portion of the main frame and the shield 18 can shield the inner sides of the funnel. However, a side space 19 between the main frame and the tension mask is exposed to the earth magnetic field.

Accordingly, when the color cathode ray tube having the inner shield 9 is operated to scan the electron beam into the panel, as shown in FIG. 4A, the electron beam 6 is distorted due to the earth magnetic field in passing through the funnel and a slot of the tension mask 3, and thus landed on a different fluorescent material.

That is, when the electron beam 6 is scanned to the whole regions of the panel, the electron beam 6 is deflected due to the deflecting yoke in a horizontal or vertical direction, and thus landed on an original position. However, in the case that a direction of the electron beam is changed by the deflecting yoke or the external earth magnetic field is varied, the path of the electron beam is distorted, and thus the electron beam is landed on an after-movement position.

As a result, as shown in FIG. 4B, the electron beam 6 is not landed on the original fluorescent material 16, but mistakenly landed on the black matrix 15 coated between the fluorescent materials 16. In addition, a different color fluorescent material 16 on the after-movement position may be emitted due to distortion of the path of the electron beam 16, thereby reducing chrominance purity of the screen.

Moreover, the main frame, sub frame and beam shield for shielding the earth magnetic field consist of a material having low permeability which is inversely proportional to magnetic flux strength and proportional to magnetic flux density, and thus the path of the electron beam is distorted.

In addition, the electron beam is reflected from the main or sub frame, to cause halation on the screen. Therefore, the screen is dimmed.

The rotation redundancy and magnetic field redundancy for deflecting the electron beam are restricted due to the halation. It is thus difficult to improve color chrominance of images.

SUMMARY OF THE INVENTION

Accordingly, an object of the present invention is to provide a color cathode ray tube which can improve color chrominance, rotation redundancy and magnetic field redundancy, by providing a magnetic shield structure for landing an electron beam on a designated fluorescent material without distorting a path of the electron beam.

In order to achieve the above-described object of the present invention, in a color cathode ray tube including a tension mask assembly consisting of a tension mask for color-discriminating an electron beam, and a main frame and a sub frame for supporting the tension mask, and a magnetic shield structure disposed at a funnel, for preventing deflection and distortion of the electron beam, the magnetic shield structure includes a main unit for shielding the inner sides of the funnel; and a front unit where the tension mask assembly is inserted.

Preferably, the front unit has a hole so that the tension mask assembly can be inserted into the hole. Both end portions of the front unit have side walls.

More preferably, the main unit has an electron beam passing hole, and is formed in a barrel shape corresponding to the inside shape of the funnel.

In addition, the front unit has at its both end portions an internally-protruded inside wall, and an outside wall for forming an outer wall separated from the inside wall by a top surface having a predetermined thickness.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

A magnetic shield structure for a color cathode ray tube in accordance with a preferred embodiment of the present invention will now be described in detail with reference to the accompanying drawings.

Figure 1:
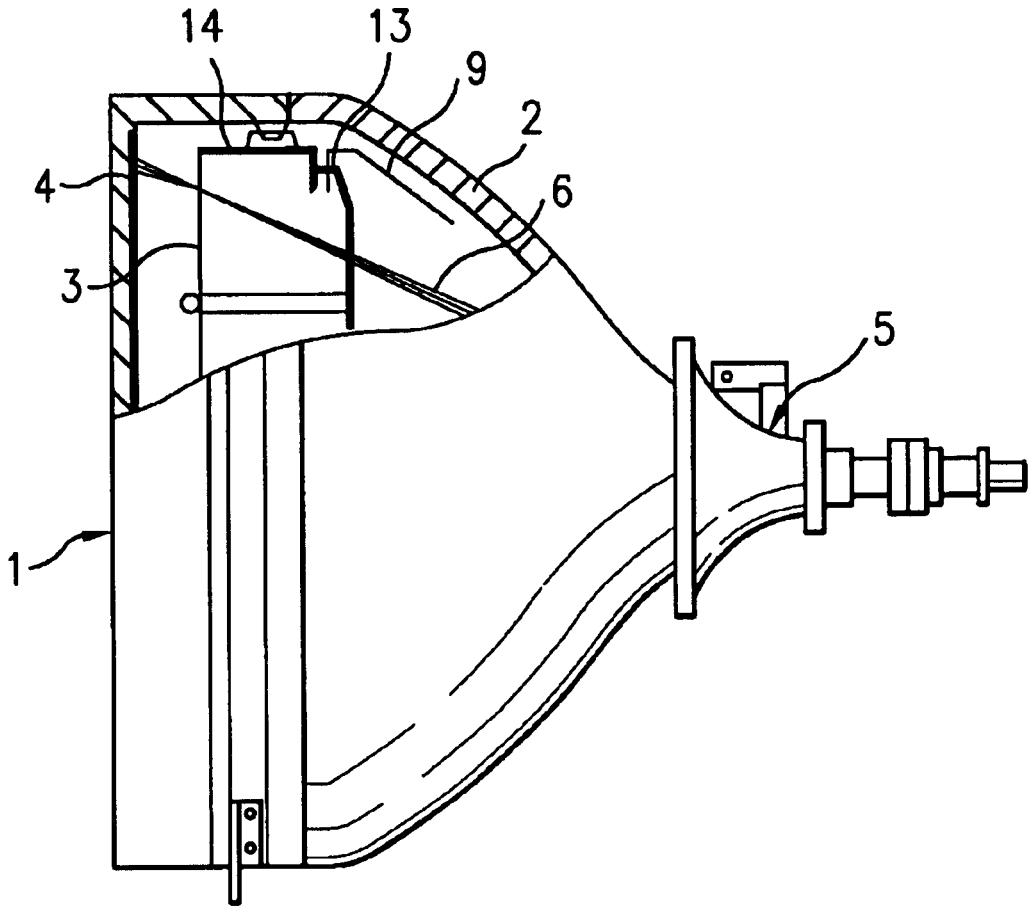
FIG. 1 Related Art
FIG. 1 is a cross-sectional view illustrating major parts of a conventional color cathode ray tube.
Figure 2A:
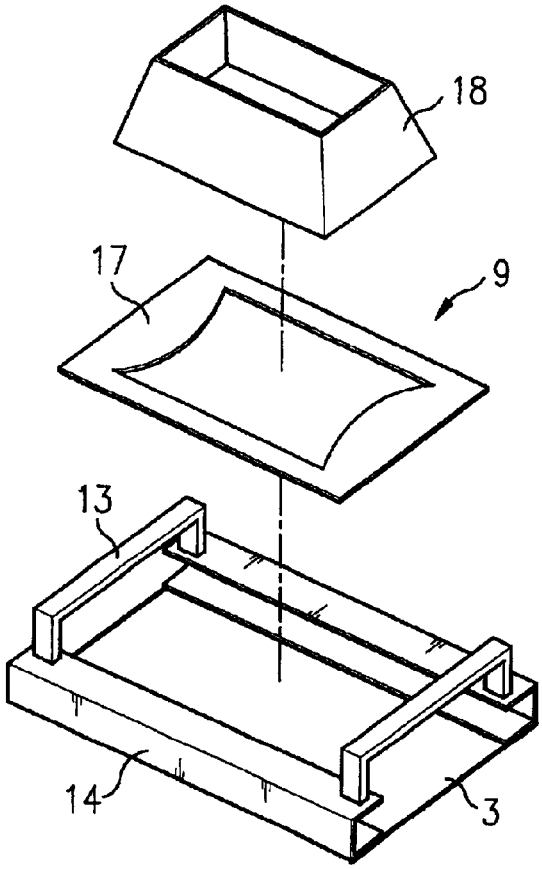
FIG. 2A Related Art
FIGS. 2A and 2B are a perspective view and a side view illustrating an inner shield and a beam shield of a tension mask assembly for the conventional color cathode ray tube.
Figure 2B:
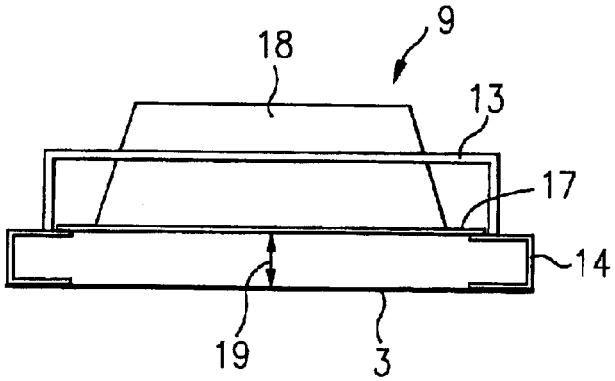
FIG. 2B Related Art
Figure 3A:
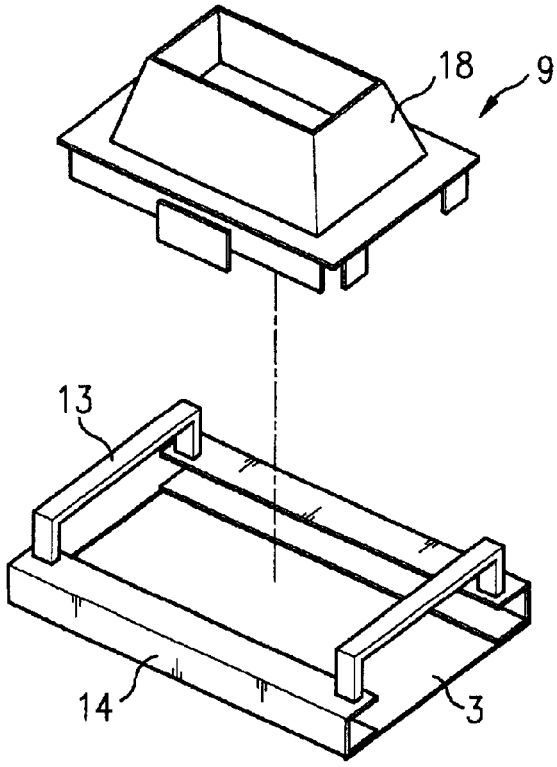
FIG. 3A Related Art
FIGS. 3A and 3B are a perspective view and a side view illustrating a magnetic shield structure for the conventional color cathode ray tube consisting of the incorporated beam shield and inner shield.
Figure 3B:
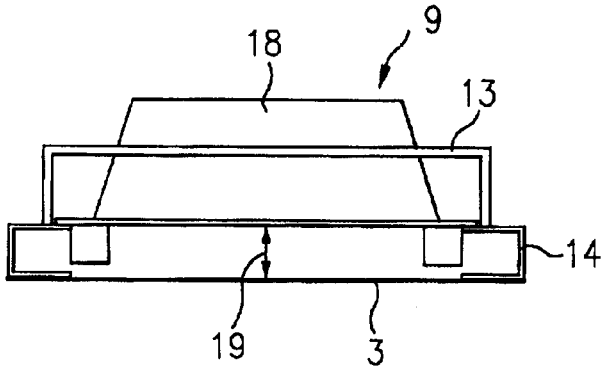
FIG. 3B Related Art
Figure 4A:
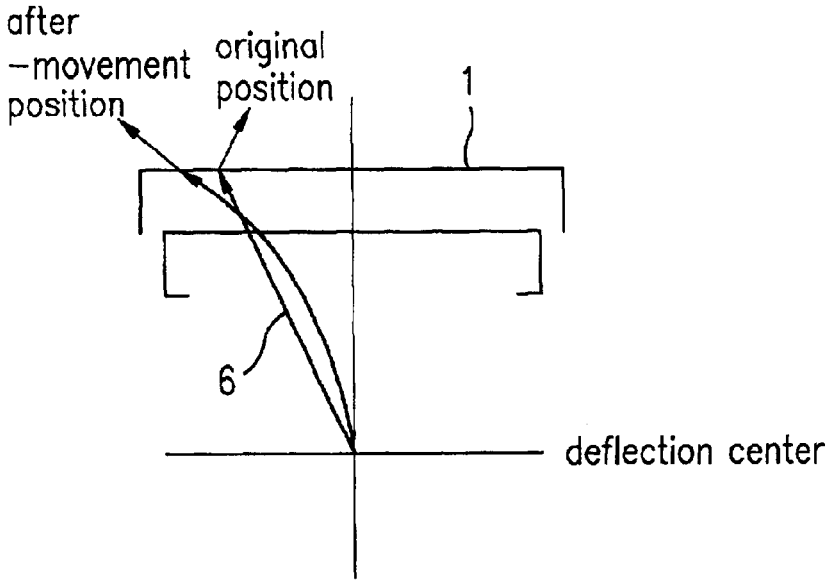
FIG. 4A Related Art
FIGS. 4A and 4B are schematic cross-sectional views showing mis-landing of the electron beam due to an earth magnetic field.
Figure 4B:
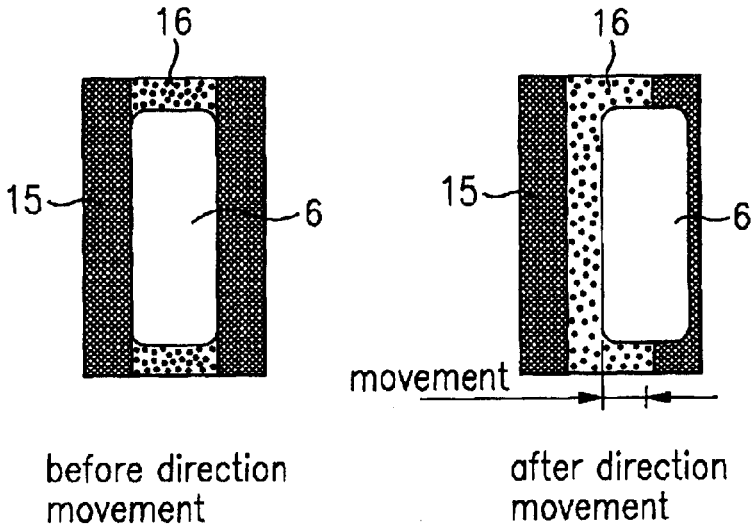
FIG. 4B Related Art
Figure 5A:
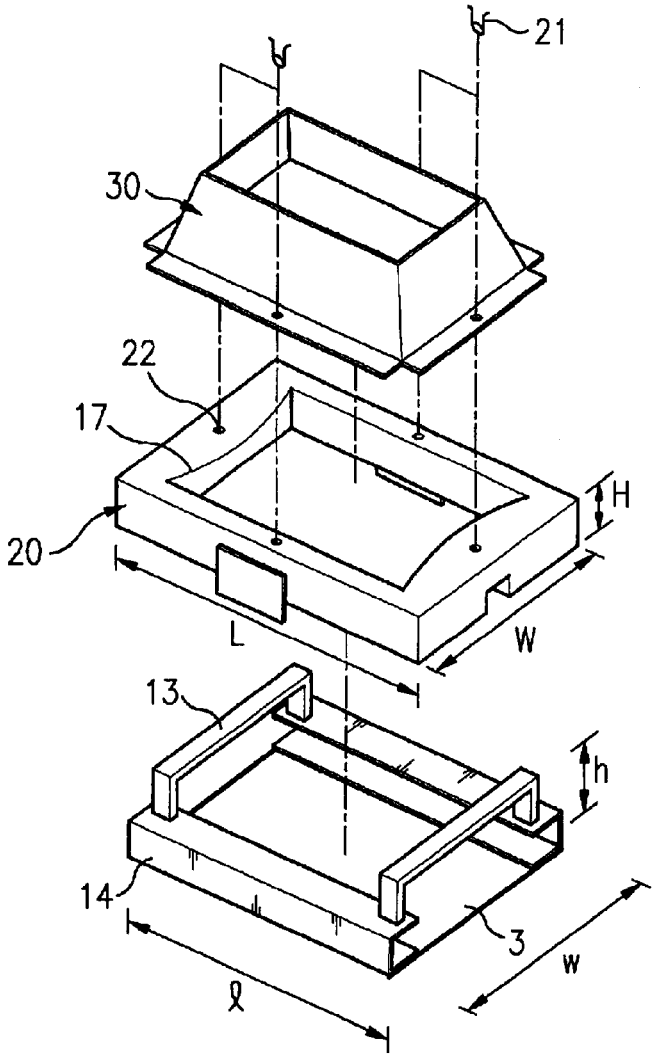
FIGS. 5A and 5B are a perspective view and a cross-sectional view illustrating a magnetic shield structure and a tension mask assembly in accordance with the present invention.

As illustrated in FIG. 5A, the magnetic shield structure includes a main unit 30 for shielding an earth magnetic field in a funnel; and a front unit 20 being operated as a beam shield, and shielding an earth magnetic field influencing on the outer portions of a tension mask 3.

In more detail, a section of the main unit 30 is formed in a trapezoidal shape having no top and bottom surfaces, so that it can be easily inserted into the bulb-shaped funnel. The respective lower side portions of the main unit 30 are externally curved to be easily assembled with the front unit 20, and fixing pin inserting holes 22 are formed at predetermined positions.

In addition, the front unit 20 has a hole so that a tension mask assembly can be inserted into the hole. A top surface having a predetermined thickness is formed in a square barrel shape between an inside wall surrounding the center hole and an outside wall forming an outer wall.

Here, a long-side unit of the inside wall is slightly longer than the main frame(l), and a short-side unit of the inside wall is slightly longer than the sub frame(w). A long-side unit of the front unit 20 has a length(L) and a short-side unit thereof has a length(W).

The short-side unit inside wall 17 of the front unit 20 is internally protruded in an arc shape so that an electron beam can be projected merely to an effective surface of the tension mask 3. A height(H) of the front unit 20 is greater than a height(h) between the highest point of the sub frame 13 and a half point of the main frame 14.

In addition, fixing pin inserting holes 22 are formed on the top surface of the front unit 20 correspondingly to the fixing pin inserting holes 22 on the main unit 30.

Figure 5B:
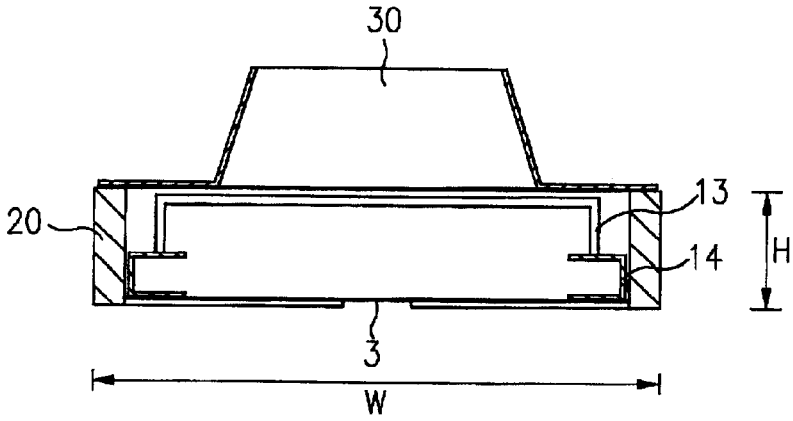

The main inner shield 9 is positioned on the front unit 20, and fixing pins 21 are inserted into the fixing pin inserting holes 22. When the thusly-assembled magnetic shield structure is assembled with the tension mask assembly as shown in FIG. 5B, the top and side surfaces of the frames 13, 14 are positioned in the front inner shield 20.

Here, a general model of an identical standard may replace the main unit 30. If so, the main unit 30 and the front unit 20 are welded.

Figure 6A:
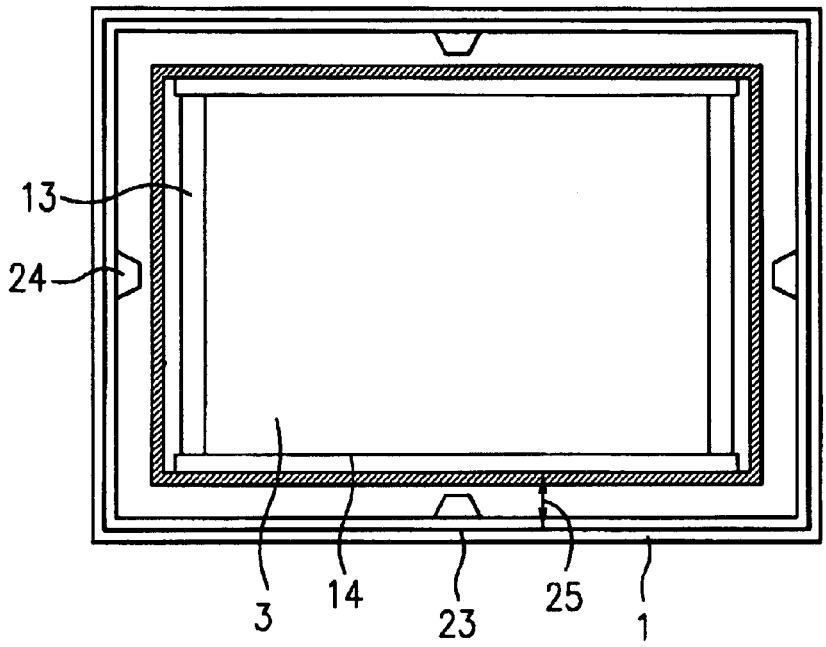
FIG. 6A is a front view showing a state where a magnetic assembly consisting of the magnetic shield structure and the tension mask assembly of FIG. 5B is fixed in a panel.

In the color cathode ray tube having the tension mask assembly and the magnetic shield structure as shown in FIG. 6A, the tension mask assembly which is fixed by stud pins 24 and which consists of the tension mask 3 and frames 14, 13 is positioned in the panel 1 where images are reproduced, and the magnetic shield structure indicated by slant lines surrounds the tension mask assembly.

That is, the indicated portion of the panel 1 is the front unit 20 of the magnetic shield structure, and reference numeral 23 denotes an end portion of the front unit 20. The end portion of the front unit 20 is positioned in the range of reference numeral 24 to completely shield the outer portions of the tension mask 3.

The front unit 20 consists of a metal of high permeability so that it can perform a magnetic shield function and a beam shield function. At this time, SCP material having a thickness of 1.5 t may be employed. A high permeability material having a thickness of 0.1 to 0.5 t may increase efficiency.

The permeability represents magnetic flux density to magnetic field strength. Therefore, there is used a material having sufficient magnetic flux density to shield the earth magnetic field.

When the color cathode ray tube having the magnetic shield structure is operated, the electron beam is scanned from the electron gun into the panel by a force according to Fleming's left-hand rule represented by following formula 1:

$$\vec{F}=Q\times[\vec{E}+\vec{v}\times\vec{B}] \qquad \text{<Formula 1>}$$

That is, in order to minimize an influence of an external magnetic field B on the internal electron beam, the electron beam passes through the magnetic shield structure consisting of the high permeability material, and is landed on a predetermined fluorescent material.

Figure 6B:
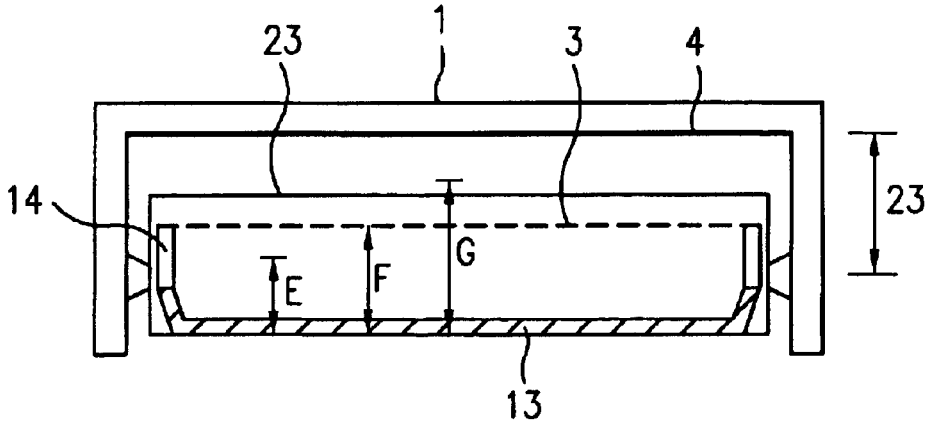
FIG. 6B is a top view showing variations of a height of a front unit of the magnetic shield structure.

As shown in Table 1, a height of the front inner shield shown in FIG. 6B may be obtained by experiments.

TABLE 1

| Position of End portion of Front inner shield | Movement of Electron beam by Earth magnetic field in up/down movement |
|---|---|
| When end portion of front inner shield is positioned in half point of main frame(E), | 35 μm |
| When end portion of front inner shield is positioned in end portion of main frame(F), | 45 μm |
| When end portion of front inner shield is positioned in half point between tension mask and fluorescent surface(G), | 60 μm |

The front unit 20 shields the earth magnetic field influencing on the tension mask 3, and thus the movement of the electron beam passing through the tension mask 3 is reduced.

Accordingly, the end portion 23 of the front inner shield 9 is positioned in a spatial range between the half height of the main frame 7 and the rear portion of the fluorescent surface 4 of the panel 1, thus deciding the height of the front unit 20.

The front unit 20 intercepts the electron beam scanned to the outer portions of the effective surface, thereby preventing halation where the screen is dimmed due to a strong electron beam generated by the electron beam scanned to and reflected from the main frame 14 and the sub frame 13. As a result, a rotation direction and angle of the electron beam and a magnitude of the magnetic field are not restricted by a deflecting yoke, and thus the electron beam can be adjusted to improve color chrominance.

As discussed earlier, it is understood that various changes and modifications can be made on the magnetic shield structure by one skilled in the art in consideration of magnetic shield effects and shapes of the tension mask assembly.

What is claimed is:

1. A cathode ray tube, comprising:

a panel;

a funnel being fixed to a rear of the panel;

a tension mask assembly including a tension mask for selectively passing electron beams therethrough and a main frame and sub frame for supporting the tension mask; and a magnetic shield structure disposed in a funnel for preventing deflection and distortion of the electron beams, wherein the magnetic shield structure includes: a main unit for shielding inner sides of the funnel; and a front unit configured to accommodate the tension mask assembly and having side walls extending in a direction parallel to a longitudinal axis of the cathode ray tube on short sides thereof.

2. The cathode ray tube according to claim 1, wherein the front unit has a hole into which the tension mask assembly can be inserted, and both end portions of the front unit have side walls.

3. The cathode ray tube according to claim 2, wherein the front unit has at its both end portions an internally-protruded inside wall, and an outside wall for forming an outer wall separated from the inside wall by a top surface having a predetermined thickness.

4. The cathode ray tube according to claim 1, wherein the main unit has an electron beam passing hole, and is formed in a barrel shape corresponding to an inside shape of the funnel.

5. The cathode ray tube according to claim 2, wherein the main unit and the front unit are combined by fixing pins.

6. The cathode ray tube according to claim 2, wherein the main unit and the front unit are welded.

7. The cathode ray tube according to claim 1, wherein the front unit comprises a metal of high permeability.

8. The cathode ray tube according to claim 3, wherein the end portion of the front unit is positioned in a spatial range between the half height of the main frame and the inner surface of the panel.

9. The cathode ray tube according to claim 1, wherein the cathode ray tube is a color cathode ray tube.

10. A cathode ray tube, comprising a panel;

a funnel being fixed to a rear of the panel;

a tension mask assembly including a tension mask for selectively passing electron beams therethrough and a main frame and sub frame for supporting the tension mask; and a magnetic shield structure disposed in a funnel for preventing deflection and distortion of the electron beams, wherein the magnetic shield structure includes: a main unit for shielding inner sides of the funnel; and a front unit configured to accommodate the tension mask assembly and having side walls extending in a direction parallel to a longitudinal axis of the cathode ray tube on short sides thereof, wherein an end portion of the front unit is positioned in a spatial range between a half height of the main frame and an inner surface of the panel.

11. The cathode ray rube according to claim 10, wherein the cathode ray tube is a color cathode ray tube.

12. A magnetic shield structure for a cathode ray tube comprising a panel, a funnel fixed to a rear of the panel, and a tension mask assembly including a tension mask configured to selectively pass electron beams therethrough and a main frame and sub frame configured to support the tension mask, the magnetic shield structure being disposed in the funnel and configured to prevent deflection and distortion of the electron beams, the magnetic shield structure comprising:

a main unit configured to shield inner sides of the funnel; and a front unit configured to accommodate the tension mask assembly and having side walls extending in a direction parallel to a longitudinal axis of the cathode ray tube on short sides thereof configured to shield the tension mask assembly.

13. The magnetic shield structure according to claim 12, wherein an end portion of the front unit is positioned in a spatial range between a half height of the main frame and an inner surface of the panel.

14. The cathode ray tube according to claim 12, wherein the cathode ray tube is a color cathode ray tube.

15. The magnetic shield structure according to claim 12, wherein the front unit has a hole configured to receive therein the tension mask assembly.

16. The magnetic shield structure according to claim 12, wherein the front unit has side walls extending in a direction parallel to a longitudinal axis of the cathode ray tube on both long and short sides thereof configured to shield the tension mask assembly.

17. The magnetic shield structure according to claim 12, wherein the front unit has at end portions an internally-protruded inside wall, and an outside wall separated from the inside wall by a surface having a predetermined thickness.

18. The magnetic shield structure according to claim 12, wherein the main unit has an electron beam passing hole.

19. The magnetic shield structure according to claim 12, wherein the main unit is formed in a shape corresponding to a shape of an inside surface of the funnel.

20. The magnetic shield structure according to claim 12, wherein the main unit and the front unit are attached by fixing pins.

21. The magnetic shield structure according to claim 12, wherein the main unit and the front unit are welded together.

22. The magnetic shield structure according to claim 12, wherein the front unit is formed of a metal having high permeability.

* * * * *